United States Patent [19]

Martin

[11] 4,171,279

[45] Oct. 16, 1979

[54] POLYGLYCOLAMINE CORROSION INHIBITORS

[75] Inventor: Charles W. Martin, Lake Jackson, Tex.

[73] Assignee: The Dow Chemical Company, Midland, Mich.

[21] Appl. No.: 777,190

[22] Filed: Mar. 14, 1977

[51] Int. Cl.[2] ..... C11D 7/32

[52] U.S. Cl. ..... 252/148; 252/391; 252/392; 252/180; 260/584 B; 422/12

[58] Field of Search ..... 252/148, 391, 392, 180, 252/181; 260/584 R, 584 B; 21/2.7 R

[56] References Cited

U.S. PATENT DOCUMENTS

| | | | |
|---|---|---|---|
| 3,123,641 | 3/1964 | Longley | 260/584 B |
| 3,152,187 | 10/1964 | Coyne et al. | 252/392 |
| 3,161,682 | 12/1964 | Lesesne et al. | 260/584 B |
| 3,200,106 | 8/1965 | Dickson | 260/584 B |
| 3,203,904 | 8/1965 | Brown | 252/392 |
| 3,607,781 | 1/1971 | Kanek et al. | 252/148 |

FOREIGN PATENT DOCUMENTS

| | | | |
|---|---|---|---|
| 535241 | 1/1957 | Canada | 252/392 |
| 695804 | 10/1964 | Canada | 252/392 |

*Primary Examiner*—George F. Lesmes
*Assistant Examiner*—E. Rollins Buffalow
*Attorney, Agent, or Firm*—B. G. Colley

[57] ABSTRACT

Polyglycolamines such as aminated polypropylene or polybutylene glycols and amine-initiated polypropylene and polybutylene glycols such as oxypropylated or oxybutylated lower alkanolamines inhibit the corrosion of ferrous metals by a nonoxidizing acid such as hydrochloric acid. Polyglycolamines of this class having an average molecular weight in the appropriate range of 300–5000 are effective inhibitors in 5–15 percent hydrochloric acid at moderately elevated temperatures.

8 Claims, No Drawings

POLYGLYCOLAMINE CORROSION INHIBITORS

BACKGROUND OF THE INVENTION

This invention relates to a method for inhibiting the corrosion of ferrous metals by nonoxidizing acids and it also relates to the inhibited acid compositions.

It is known that higher alkylamines are acid corrosion inhibitors. It is also known that triethanolamine is a moderately good inhibitor in some acid systems. These compounds, however, are fully effective only under somewhat limited conditions and are particularly prone to lose their corrosion inhibiting properties as the temperature or the acid concentration increases.

SUMMARY OF THE INVENTION

It has now been found that certain poly(lower)alkyleneglycolamines are highly effective to inhibit the corrosion of ferrous metals by hydrochloric acid and other nonoxidizing acids such as dilute sulfuric acid even when the acid is in moderately high concentration and the temperature is moderately elevated. The class of polyglycolamines is defined as those having an average molecular weight of about 300 to about 5000 wherein the alkylene moieties are at least half, and preferably all or substantially all, of 3–4 carbon atoms. This class includes polypropylene glycolamines, polybutylene glycolamines, and oxyalkylated amines of several kinds, particularly the oxyalkylated lower alkanolamines which are the condensation products of an alkanolamine with propylene oxide or butylene oxide or mixture thereof, and the physical and chemical mixtures possible under the above definition.

DETAILED DESCRIPTION

The polyglycolamines of this invention fall into two subclasses, oxyalkylated amines, particularly oxyalkylated alkanolamines and the aminated polygolycols. In the first group which comprises oxypropylated or oxybutylated lower alkanolamines, particularly preferred compounds are those obtained by condensing butylene oxide with a trialkanolamine such as triethanolamine. These products are triols having a tertiary amine nitrogen atom in their structure.

Other effective amine-initiated polyglycols include the products obtained by condensing butylene oxide, propylene oxide, or mixtures of these within the definition stated above with any of various primary and secondary nonaromatic amines. These amine initiators include alkyl and dialkyl amines where the alkyl radicals are of about 1–8 carbon atoms, for example, diethylamine, n-butylamine, dipentylamine, 2-ethylhexylamine, dioctylamine, N-methyl-n-butylamine, and the like. Alicyclic and heterocyclic amines where the heterocyclic atoms are oxygen or nitrogen and the rings are of 5–6 atoms also serve as initiators which produce polypropylene and polybutylene glycols of high inhibiting activity. Examples of these amines are cyclopentylamine, N-methylcyclohexylamine, dicyclohexylamine, morpholine, piperidine, piperazine and pyrrolidine.

The second group, the aminated polypropylene and polybutylene glycols, are primarily polyoxyalkylene diamines mixed with a smaller amount of the corresponding monoamine wherein only one hydroxyl group of the polyglycol molecule has been replaced by an amino group. These mixtures can be prepared by an amination method, for example, by reacting a polyglycol disulfonate or a corresponding monosulfonated polyglycol chloride with ammonia as shown by Lee et al., U.S. Pat. No. 3,236,895. This group of polyglycolamines overlaps the first-described group in that the monoamines can be prepared by either method, i.e., by oxyalkylating a monoalkanolamine or by the amination reaction such as that of the cited patent.

With all of the polyglycolamines described above, some increase in inhibiting effect is found with increasing molecular weight. In relatively dilute hydrochloric acid, of 1–5 percent concentration, for example, there is little difference in effect and polyglycolamines in the lower molecular weight range of 300–600 provide nearly as effective inhibition of corrosion as do the corresponding amines of higher molecular weight. However, in acid of about 15 percent concentration, for example, fully effective inhibition is not provided until the molecular weight of the polyglycolamine is increased above about 1000. Thus, the choice of an effective inhibitor in a particular situation would depend largely upon the concentration of acid involved. Increasing temperature has a similar but somewhat lesser effect.

The polyglycolamine inhibitors of this invention are effective generally to inhibit corrosion of ferrous metals by aqueous nonoxidizing acids of low to moderate concentration, particularly in acid concentrations below about 20 percent. Hydrochloric acid is the most commonly encountered acid of this group, but the polyglycolamine inhibitors are similarly effective in other nonoxidizing acids such as dilute sulfuric acid, hydrobromic acid, and phosphoric acid.

The term ferrous metals is used herein to include iron, steel, stainless steel, and in general, alloys containing at least about 85 percent of iron.

Concentrations of polyglycolamine which are effective to provide substantial inhibition of ferrous metals by a nonoxidizing acid lie in the approximate range of 0.001–0.5 percent by weight, depending upon the conditions of acid concentration and maximum temperature likely to be encountered. High concentrations of polyglycolamine, or course, can be used but ordinarily provide diminishing additional benefit. There is no critical lower limit as any significant amount of polyglycolamine will provide some inhibition. The lowest practically effective concentration in a particular situation will depend upon the acid concentration, the temperature, and the iron alloy involved.

The polyglycolamines of this invention thus have certain unique advantages as corrosion inhibitors in addition to the low concentrations required for effective inhibition. Because of their molecular structure and the way in which they are made, these polyglycolamines are readily tailored to fit a particular use by adjusting the polyglycol chain length or the identity or proportion of the oxyalkylene units which form the chain. In this way, corrosion inhibition efficiency and solubility characteristics can be optimized for the conditions of acid concentration, temperature, and type or types of ferrous metal encountered in a particular situation. Solubility characteristics of these compounds are particularly advantageous in that solubility generally appears to decrease with increasing temperature, causing the amine to cling to a metal surface more tightly rather than being more rapidly leached off.

CORROSION TEST PROCEDURE

SA 1010 carbon steel coupons with rounded edges and a surface area of 6.44 square inches were used to determine inhibition of corrosion. The test coupons were cleaned by rinsing twice in 1,1,1-trichloroethane and once in acetone, then immersing in 18–20 percent HCl at room temperature for 15 minutes, rinsing with water, scrubbing with pumice soap and a brush, and finally rinsing with hot water followed by an acetone rinse. The cleaned and dried coupons were stored in a desiccator for use.

In the corrosion tests,—weighed coupons were put in 150 g. of aqueous HCl containing the desired amount of amine and control coupons were put in 150 g. of uninhibited HCl of the same concentration, then both containers were allowed to stand at the test temperature for the desired length of time. Both sets of coupons were then removed from the acid solutions and cleaned by rinsing with water, scrubbing with pumice soap, and rinsing once with hot water and twice with acetone. The cleaned and dried coupons were weighed to determine weight losses. The average weight losses for the two sets of coupons were used to compute the percent inhibition for the test polyglycolamine by the following formula:

$$\% \text{ inhibition} = \frac{\text{wt. loss uninhibited} - \text{wt. loss inhibited}}{\text{wt. loss uninhibited}} \times 100$$

IDENTIFICATION OF TEST AMINES

The following abbreviations were used to identify the amines used in the corrosion inhibition tests:

| Abbreviation | Identification |
|---|---|
| MEA | monoethanolamine |
| DEA | diethanolamine |
| TEA | triethanolamine |
| TE-3 | triethanolamine + 3 moles ethylene oxide |
| TE-6 | triethanolamine + 6 moles ethylene oxide |
| TE-10 | triethanolamine + 10 moles ethylene oxide |
| MSBA | mono-sec-butanolamine |
| DSBA | di-sec-butanolamine |
| TSBA | tri-sec-butanolamine |
| TB-3 | triethanolamine + 3 moles butylene oxide |
| TB-6 | triethanolamine + 6 moles butylene oxide |
| TB-10 | triethanolamine + 10 moles butylene oxide |
| TB-16 | triethanolamine + 16 moles butylene oxide |
| TBM | equal mixture of TB-3, 6, and 10 |
| TP-3 | triethanolamine + 3 moles propylene oxide |
| TP-6 | triethanolamine + 6 moles propylene oxide |
| TP-10 | triethanolamine + 10 moles propylene oxide |
| AP-400 | aminated polypropylene glycol of 400 mole wt. |
| AP-2000 | aminated polypropylene glycol of 2000 mole wt. |
| APG-3000 | aminated polypropylene glycol of 3000 mole wt. initiated with glycerol |

EXAMPLE 1

This corrosion test was run in 5 percent HCl at room temperature for four days according to the procedure described above. A number of alkanolamines and oxyethylated triethanolamines were also tested in order to show the superior inhibiting properties of oxypropylated and oxybutylated triethanolamines of the invention. In each case, the concentration of amine was 0.2 percent by weight.

| Amine | % Inhibition |
|---|---|
| TP-3 | 94.85 |
| TP-6 | 94.91 |
| TP-10 | 92.43 |
| TB-3 | 94.55 |
| TB-6 | 95.32 |
| TB-10 | 96.79 |
| MEA | 11.21 |
| DEA | 21.77 |
| TEA | 93.13 |
| MSBA | 51.33 |
| DSBA | 35.59 |
| TSBA | 58.71 |
| TE-3 | 94.74 |
| TE-6 | 91.12 |
| TE-10 | 92.74 |

EXAMPLE 2

Using the same general procedure, corrosion tests were run at 175° F. for 5 hours in 5 percent HCl. A range of amine concentrations was covered and amines TE-3 and TE-10 were run for purpose of comparison.

| Amine | % Concentration | % Inhibition |
|---|---|---|
| TE-3 | 0.1 | 85.91 |
| TE-10 | 0.1 | 85.68 |
| TP-3 | 0.1 | 93.52 |
| | 0.0677 | 80.88 |
| | 0.0333 | 76.91 |
| TP-10 | 0.1 | 90.48 |
| | 0.0677 | 86.48 |
| TB-3 | 0.1 | 94.07 |
| | 0.0677 | 92.50 |
| | 0.0333 | 81.45 |
| TB-6 | 0.1 | 95.64 |
| | 0.0677 | 93.53 |
| | 0.0333 | 91.72 |
| TB-10 | 0.1 | 97.37 |
| | 0.0677 | 96.90 |
| | 0.0333 | 96.63 |
| | 0.0200 | 95.54 |
| TB-16 | 0.0333 | 96.97 |
| | 0.0200 | 95.71 |
| TB-M | 0.0677 | 94.27 |
| | 0.0333 | 95.86 |

EXAMPLE 3

Several polypropylene glycolamines of the invention were tested by the procedure described in Example 2.

| Amine | % Concentration | % Inhibition |
|---|---|---|
| AP-400 | 0.100 | 95.53 |
| | 0.0333 | 93.66 |
| AP-2000 | 0.100 | 96.39 |
| | 0.0333 | 95.06 |
| APG-3000 | 0.100 | 96.48 |
| | 0.0333 | 95.63 |

EXAMPLE 4

The oxybutylated triethanolamines and polypropylene glycolamines of Examples 3 and 4 were tested by the general corrosion inhibition test procedure outlined above but using stronger acid: five hours in 15 percent HCl at 150° F.

| Amine | % Concentration | % Inhibition |
|---|---|---|
| TB-3 | 0.100 | 55.19 |

-continued

| Amine | % Concentration | % Inhibition |
|---|---|---|
| TB-6 | 0.100 | 71.68 |
| TB-10 | 0.100 | 84.83 |
| | 0.050 | 79.63 |
| | 0.020 | 71.52 |
| TB-16 | 0.100 | 96.22 |
| | 0.050 | 96.49 |
| | 0.020 | 96.46 |
| | 0.010 | 93.94 |
| | 0.005 | 92.55 |
| AP-400 | 0.100 | 77.81 |
| AP-2000 | 0.100 | 96.38 |
| APG-3000 | 0.100 | 97.28 |
| Tallowamine | 0.100 | 29.20 |

The Tallowamine which was run for purpose of comparison is a mixture of $C_{16}$–$C_{18}$ amines derived from animal fats. Although it shows some corrosion inhibition in lower HCl concentrations, it is ineffective under the conditions of Example 4.

Polyglycolamines of the invention other than those exemplified above show similar corrosion inhibition effectiveness. Some of these compounds are condensates of butylene oxide with other lower alkanol amines such as diethanolamine, isopropanolamine, and tri-sec-butanolamine, condensates of mixed butylene and propylene oxides with lower alkanolamines, and aminated or amine-initiated polybutyleneglycols, all of these within the approximate average molecular weight limits previously specified. The polyglycolamine obtained by condensing ten moles of butylene oxide with a mole of n-butylamine was particularly effective for inhibiting corrosion at low acid concentrations. Similarly, polyglycolamines made from heterocyclic and alicyclic amine initiators as previously described are highly effective inhibitors.

When the hydrochloric acid used in the above tests is replaced by sulfuric acid, hydrobromic acid, phosphoric acid, or other nonoxidizing acids of equivalent concentration, similar inhibition of corrosion of iron or steel is found.

I claim:

1. An aqueous nonoxidizing acid composition consisting essentially of said aqueous acid and a small amount effective to inhibit the corrosion thereby of ferrous metals of a poly(lower)alkyleneglycolamine of about 300 to about 5000 average molecular weight wherein said poly(lower)alkyleneglycolamine is at least one of an aminated polyalkylene glycol wherein the alkylene moieties are substantially all of 3–4 carbon atoms or the condensation product of propylene oxide, butylene oxide, or a mixture of said oxides with a lower alkanolamine or a primary or secondary nonaromatic amine which is an alkylamine wherein alkyl is of 1–8 carbon atoms, an alicyclic amine, or an oxygen or nitrogen heterocyclic amine wherein the alicyclic or heterocyclic ring is of 5–6 atoms.

2. The composition of claim 1 wherein the acid is hydrochloric acid.

3. The composition of claim 2 wherein the polyglycolamine is an aminated polypropylene glycol or an aminated polybutylene glycol.

4. The composition of claim 3 wherein the polyglycolamine is an aminated polypropylene glycol.

5. The composition of claim 2 wherein the amine is the condensation product of a lower alkanolamine with propylene oxide, butylene oxide, or a mixture thereof.

6. The composition of claim 5 wherein the amine is the condensation product of triethanolamine with butylene oxide.

7. The composition of claim 1 wherein the aqueous acid composition contains about 0.001–0.5 percent by weight of the polyglycolamine.

8. The composition of claim 7 wherein the acid is hydrochloric acid, hydrobromic acid, phosphoric acid, or dilute sulfuric acid.

* * * * *